United States Patent [19]

Gressett, Jr. et al.

[11] Patent Number: 4,669,350

[45] Date of Patent: Jun. 2, 1987

[54] CLAMPING NUT AND METHOD

[76] Inventors: Charles A. Gressett, Jr., 808 W. Lime St., Brea, Calif. 92621; John F. Page, 12613 Gabbett, La Mirada, Calif. 90638

[21] Appl. No.: 697,220

[22] Filed: Jan. 31, 1985

[51] Int. Cl.[4] ..... G10D 3/12

[52] U.S. Cl. ..... 84/314 N

[58] Field of Search ..... 84/214, 314 N, 318

[56] References Cited

U.S. PATENT DOCUMENTS

| | | | |
|---|---|---|---|
| 144,842 | 11/1873 | Ellis | 84/214 |
| 449,216 | 3/1891 | Gassett | 84/318 |
| 582,030 | 5/1897 | Walker | 84/314 R |
| 617,915 | 1/1899 | Wells | 84/297 R |
| 907,713 | 12/1906 | Avisus | 84/214 |
| 1,338,583 | 4/1920 | Neft | 84/314 N |
| 2,241,284 | 5/1941 | Walder | 84/312 |
| 3,191,480 | 6/1965 | Lowe | 84/318 |
| 3,429,214 | 2/1969 | Jones, Sr. | 84/314 |
| 3,583,272 | 6/1971 | Eurich | 84/267 |
| 3,599,524 | 8/1971 | Jones | 84/312 |
| 3,693,490 | 9/1972 | Raphael | 84/202 |
| 3,695,137 | 10/1972 | Eurich | 84/312 |
| 3,739,680 | 6/1973 | Christiansen | 84/266 |
| 4,078,468 | 3/1978 | Civitello | 84/274 |
| 4,135,426 | 1/1979 | Rickard | 84/1.16 |
| 4,171,661 | 10/1979 | Rose | 84/313 |
| 4,175,467 | 11/1979 | Lashley | 84/312 |
| 4,201,108 | 5/1980 | Bunker | 84/1.16 |
| 4,248,127 | 2/1981 | Lieber | 84/314 |
| 4,304,163 | 12/1981 | Siminoff | 84/314 |
| 4,324,165 | 4/1982 | Wilkerson | 84/318 |
| 4,475,432 | 10/1984 | Stroh | 84/314 N |
| 4,517,874 | 5/1985 | Fender | 84/314 N |
| 4,574,678 | 3/1986 | Edwards | 84/314 N |
| 4,579,033 | 4/1986 | Edwards | 84/314 N |

*Primary Examiner*—Lawrence R. Franklin

*Attorney, Agent, or Firm*—Gausewitz, Carr & Rothenberg

[57] ABSTRACT

The clamping apparatus includes a row of clamping elements, each two adjacent elements having one of the guitar strings disposed therebetween. An adjustable-length bolt extends through the clamping elements to create string-clamping pressure determined both by the rotated position of a bolt head and the position of a cam, the latter being mounted at the end of the adjustable-length bolt remote from the head. In accordance with the method, the head is hand-turned to cause seating of the clamping elements on the strings, this being while the cam is in a predetermined position. Subsequently, the cam element is shifted to another predetermined position that generates a large clamping pressure on the elements to clamp the guitar strings against longitudinal shifting despite the presence of large forces such as are created by tremolo action and by bending of the strings. An adjustable-height zero-fret element is provided adjacent the clamping elements to determine string height.

3 Claims, 3 Drawing Figures

CLAMPING NUT AND METHOD

BACKGROUND OF THE INVENTION

This invention constitutes an improvement on the clamping nut, and combination thereof with guitar, described and illustrated in U.S. Pat. No. 4,475,432, issued Oct. 9, 1984, inventor Paul F. Stroh. Said patent is hereby incorporated by reference herein.

The cited Stroh patent teaches a bolt having an enlarged head adapted to be turned manually without the use of tools, such head having an axial socket allowing additional tightening of the bolt by means of a wrench.

SUMMARY OF THE INVENTION

In accordance with the present apparatus and method, no wrench is ever desired or required. Furthermore, the apparatus and method are such that the musician may make a quick change of a broken string, or effect quick tuning of any string, even during a performance, with full assurance that the clamping mechanism will return to substantially the same string-clamping force that was present before the string was broken or before the tuning was effected.

The apparatus comprises an adjustable-length bolt, one part of which is hand tightenable and another part of which is cam tightenable, the combination of hand tightening and cam tightening creating a predetermined clamping pressure on the strings and permitting quick release at any time.

In accordance with the method, the cam tightening means are first adjusted to a predetermined intermediate position. Then, the hand tightening means are hand tightened. Thereafter, the cam tightening means are shifted to a clamping position that locks the strings between adjacent blocks despite the presence of large tensile forces in the strings resulting from vibrato and "bending" actions.

To effect tuning of any string, or quick release thereof when breakage occurs, the cam tightening means is pivoted to a full-release position that permits any string to be replaced or tuned without interference from the clamping blocks.

DETAILED DESCRIPTION OF THE PREFERRED EMBODIMENT

Figure 1:
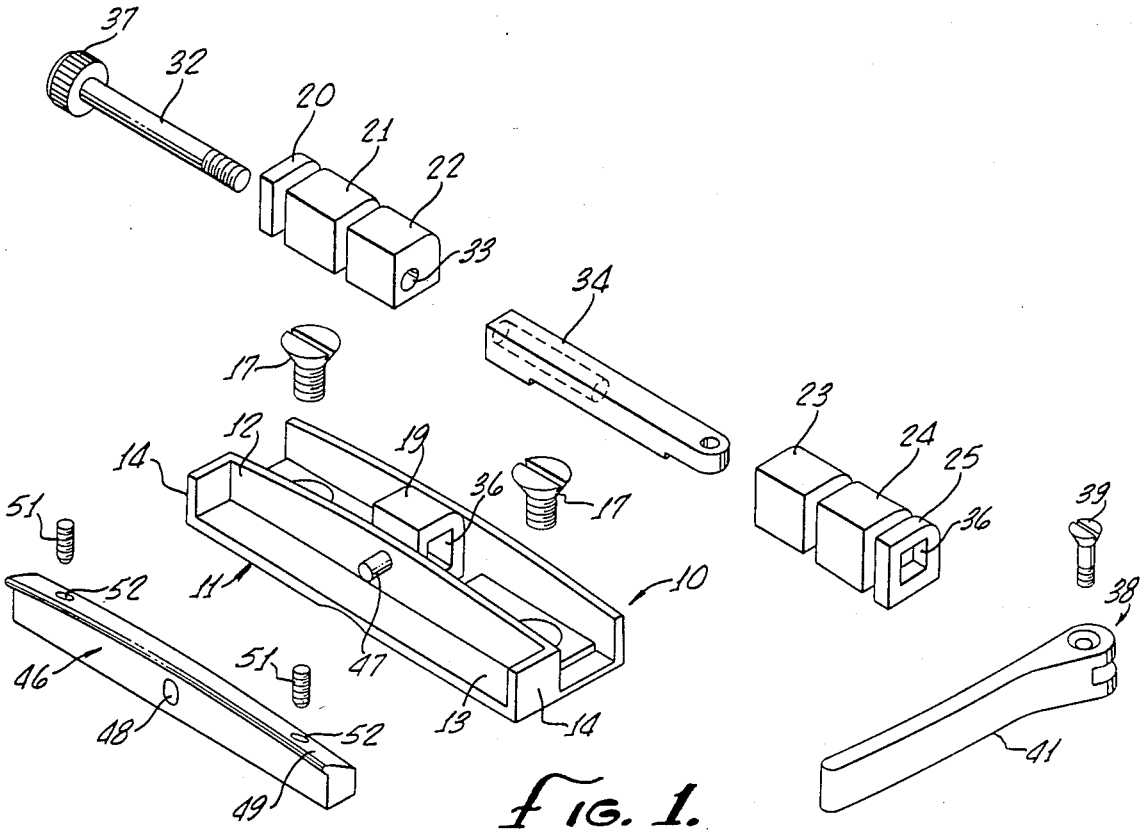
FIG. 1 is an exploded isometric view of the string clamping and adjustable nut mechanism.

As best shown in FIG. 1, the apparatus comprises a combination channel 10 and nut seat 11, the outer wall 12 of the nut seat being one sidewall of the channel 10. The nut seat also has a bottom wall 13 that is flush and integral with the bottom of the channel 10, and additionally has end walls 14 located at the ends of the channel.

Figure 3:
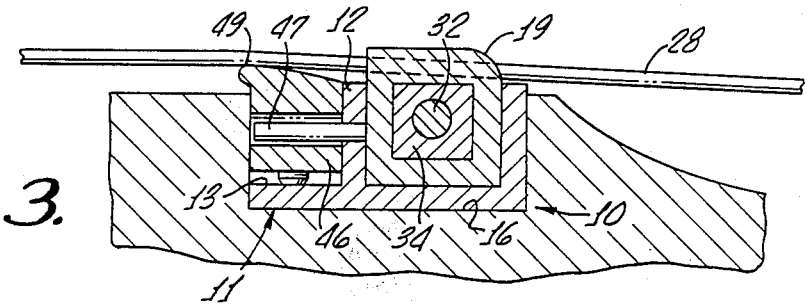
FIG. 3 is a vertical sectional view on line 3—3 of FIG. 2.

The combination channel and nut seat is mounted in a transverse groove 16 (FIG. 3) at the outer end of the neck of an electric guitar having a tremolo apparatus, reference being had to the above-cited Stroh patent which is incorporated by reference herein. The channel and nut seat are fixed in the groove 16 by means of screws 17 (FIG. 1) that extend downwardly through the bottom of the channel and into the wood, and that have upper head surfaces flush with the bottom channel wall.

Fixedly mounted, as by brazing, in the center of channel 10 is a central string-clamping element 19. Three additional string-clamping elements 20–22 are mounted in channel 10 on one side of central element 19, and three further string-clamping elements 23–25 are mounted on the channel on the other side of the central element. Preferably, the various clamping elements are shaped in general conformity to the interior surfaces of the channel, and all elements are slidable therein except the central element 19.

Figure 2:
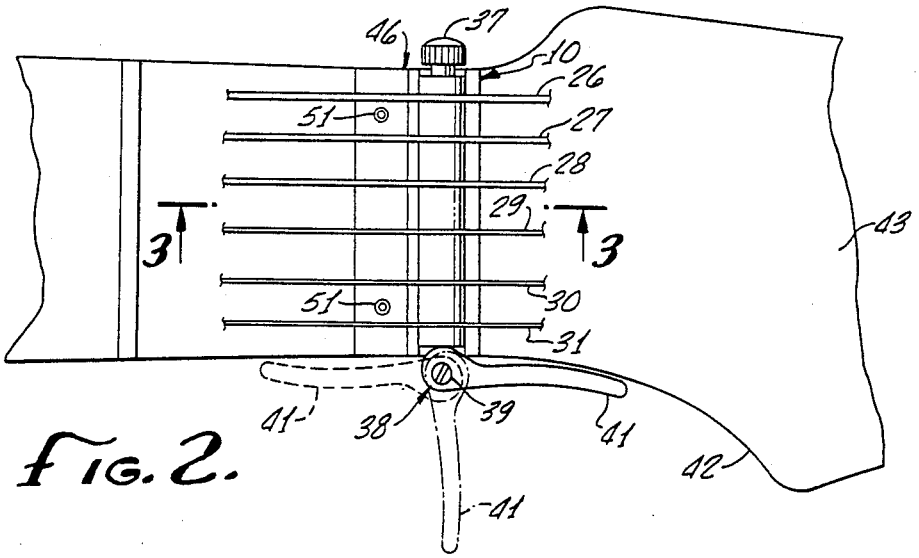
FIG. 2 is a top plan view thereof.

Thus, all of the clamping elements are mounted in a row transversely of the strings 26–31 of the guitar, reference being made to FIG. 2.

First means are provided to effect endwise compression of the indicated row, such means being hand tightenable. Second means are provided to effect endwise compression of the row, and the second means have a mechanical advantage much larger than that of the first means. Furthermore, as described subsequently, the second means have predetermined positions that are important to the performance of the method.

In the illustrated preferred form, the indicated first and second row-compression means are provided at opposite ends of an adjustable-length bolt that passes through the various clamping elements 19–25. Such bolt has an externally threaded section 32 that passes snugly but slidably through unthreaded cylindrical bores 33 in elements 20–22. The bolt portion 32 is sufficiently long that its inner end extends into the central string-clamping element 19.

The bolt also has an internally-threaded section 34, the threaded inner end of which (FIG. 1) is adapted to threadedly receive the threaded inner end of section 32. Section 34 extends snugly but slidably through bores 36 in clamping elements 23–25, and then into a bore 36*a* in the central clamping element 19.

The section 34 is noncircular in section, as are the bores 36. In the illustrated form, section 34 and the corresponding bores 36 are square in cross-section. The purpose is to prevent rotation of section 34 about its longitudinal axis and thereby maintain in a predetermined plane the associated high-mechanical-advantage means for effecting endwise compression of the row of elements. Furthermore, the square shape prevents the section 34 from turning when the section 32 is hand tightened.

The first means (low mechanical adavantage) for effecting compression of the row of clamping elements is a knurled bolt head 37 at the outer end of element 32. The head 37 is adapted to be grasped by the fingers of the musician and hand-tightened to an extent described below. The second means (high mechanical advantage) for effecting compression of the row of clamping elements is a cam device 38 that is pivotally associated by a pivotal connector 39 with the outer end of section 34.

The cam device 38 comprises two identical, parallel, spaced-apart cams disposed, respectively, in engagement with the upper and lower surfaces of section 34, such cams having the connector 39 extended vertically therethrough and through the section end. The two cams are integral with a crank or lever arm 41 that extends outwardly from the cams and is so shaped as to fit snugly against one side wall of the head 43 of the guitar when the cam is in its string-clamping position shown in solid lines in FIG. 2.

The shape of the cam device 38 is such as to achieve the results stated subsequently in relation to the description of the method of the invention.

Referring next to the nut or zero-fret portion of the apparatus, this comprises a nut or zero-fret element 46 shaped to seat relatively snugly in the nut seat 11, but with sufficient clearance to have the upward and downward, and tilting, movements described below. Although nut 46 may move relatively freely upwardly and downwardly, and tiltingly, in the nut seat 11, it may not fall out even when the guitar is not strung. This is because a pin 47 projects from wall 12 and through an oversized hole 48 in the body of the nut, reference being made to FIGS. 1 and 3.

At its upper forward edge, which projects toward the body of the guitar and overhangs the forward vertical wall of groove 16, the nut in an intonation line or zero fret. This highest edge is numbered 49. Its elevation and inclination may be adjusted by turning set screws 51 that are threaded vertically downwardly through internally-threaded bores 52 in nut 46, thus permitting the guitarist to achieve various desired spacings of the strings about the fingerboard of the guitar. The bottoms of screws 51 bear downwardly against the bottom wall 13 of the nut seat.

Proceeding next to a description of the method of the invention, the guitarist first strings the instrument while the clamping means is in a loose condition, one string passing between each two adjacent clamping elements 19–25 as shown in FIG. 2. Then, with cam crank 41 in the six o'clock position as viewed in FIG. 2, he uses his fingers to tighten the knurled bolt head 37 to a desired extent (described below). Because the bolt head 37 does not have a large diameter, the endwise compression on the row of string-clamping elements 19–25 effected by turning of bolt head 37 does not create clamping pressure sufficient to ensure against longitudinal shifting of the strings between the claming elements in response to tremolo action, bending of the strings, etc.

The "desired extent" stated in the preceding paragraph is determined by the manufacturer, and is such as to be substantially uniform for at least the great majority of guitarists. It could be that condition at which bolt head 37 first causes all of the elements 19–25 to seat on the strings therebetween. It is, however, preferred by the present manufacturer that the "desired extent" be hand tight (finger tight).

It is emphasized that string gauge is not a factor relative to degree of tightness, variations in gauge being compensated for by bolt head 37.

When the crank arm 41 is in the above-indicated six o'clock position, that is to say pointing downwardly in FIG. 2, the cam exerts (bolt head 37 being hand tight) an intermediate pressure on the row of clamping elements. To achieve full clamping pressure, and thus ensure against longitudinal string movement even under the rigorous conditions imposed by guitarists, the musician rotates crank arm 41 counterclockwise to the illustrated solid-line position at which it is adjacent the head surface 42. The cam 38 is so shaped that, when the arm 41 is in the solid-line position, the pressure on the strings is so great that the wrapped strings are frequently somewhat—but not excessively—compressed.

To completely release the strings from clamping pressure, so that they may be tuned, or replaced when broken, the guitarist pivots the crank arm 41 clockwise 180° to the position shown at the left in FIG. 2, the arm 41 then being adjacent the the neck of the guitar. Also, while the strings are thus released, the elevation of the zero fret 49 may be adjusted, or the angle thereof adjusted as desired, in order to achieve the desired spacing between the strings and fingerboard. This is effected by means of the screws 51 which are turned by a suitable wrench.

After a string has been tuned, or replaced, while the crank arm 41 is in the left-pointing release position shown in FIG. 2, the operator pivots such arm counterclockwise 180° back to the solid-line full-clamp position shown at the right in FIG. 2. It is then known that unless the musician has changed the gage of a replaced string, the degree of clamping of the strings will be the same after a string replacement as it was before the string was broken. This degree of clamping is sufficient to ensure against string movement but insufficient to excessively crush or break the wrapping on the wrapped strings.

If string gauge has changed, the musician repeats the hand-tightening procedure, described above, relative to bolt head 37.

The shape of the peripheral regions of cam 38, and the diameter of bolt head 37, are so shaped and correlated that the following results are achieved. (1) When crank arm 41 is in the intermediate (six o'clock) position, finger tightening of the bolt head 37 will compress the row of elements 19–25 sufficiently to achieve a generally predetermined amount of clamping of the strings 26–31. This "generally predetermined amount" is sufficiently high that rotation of the crank arm 41 to the full-clamp position shown in solid lines in FIG. 2 will effectively and fully clamp the strings against longitudinal movement, but is not sufficiently high that such rotation of the arm 41 to the solid-line position of FIG. 2 will crush or damage the strings.

Stated in another manner, the shape of the peripheral regions of cam 38 is such that, after bolt head 37 has been finger tightened, rotation of the crank arm 41 from the intermediate position to the full-clamp position shown in solid lines in FIG. 2 will create full clamping of the strings without damage thereto.

The shape of the peripheral regions of cams 38 are also such that, after the stated finger tightening has occured with crank arm 41 in its intermediate (six o'clock) position, rotation of the crank arm 41 to the nine o'clock position will release the clamping action and permit the musician to tune the strings or replace the same without need for rotating bolt head 37. It is emphasized that the bolt head 37 is preferably not rotated at any time except when the instrument is initially strung, or when a change in string gage has occurred.

In the appended claims, the words "hand tightenable", etc., comprehend a condition at which the bolt head 37 (for example) is only turned enough to seat all elements 19–25 on the strings, as well as the condition at which the head 37 is fully tightened manually.

The foregoing detailed description is to be clearly understood as given by way of illustration and example only, the spirit and scope of this invention being limited solely by the appended claims.

What is claimed is:

1. A clamping apparatus for clamping the strings of an electric guitar against longitudinal movements despite the presence of large forces created by vibrato and string-bending actions, comprising:

(a) a row of clamping elements, different ones of said clamping elements being adapted to have different ones of the strings of an electric guitar extended therebetween, so that sufficient endwise compression of said row clamps said guitar strings between said clamping elements and thus prevent movements of said strings in directions longitudinal of said strings, (b) first means to effect endwise compression of said row, said first means being hand tightenable and, by itself when hand tightened, not achieving row-compression force sufficient to clamp said guitar strings adequately to assure prevention of longitudinal movements thereof, said first means comprising hand-turnable threaded-fastener means, said threaded-fastener means having a hand-turnable head, (c) second means to effect endwise compression of said row, said second means being cam means hand operable from a predetermined first position, which is not the full-clamp position, to a predetermined second position at which said strings are fully clamped against longitudinal movements, said second means having a mechanical advantage large in comparison to that of said first means, so that operation thereof from said first position to said second position achieves row-compression force sufficient to effect said full clamping of said guitar strings adequately to assure prevention of longitudinal movements thereof, said head and said cam means being mounted at opposite ends of, and cooperating with, adjustable-length bolt means extending through said row of clamping elements, a part of said adjustable-length bolt means being formed by said threaded-fastener means.

2. A combination string-clamping and adjustable zero-fret mechanism for electric guitars, which comprises:

(a) a combination channel and a nut seat, said combination channel and nut seat being adapted to be mounted in a transverse groove at the outer end of a guitar neck, said nut seat being on the side of said channel relatively adjacent the guitar body when said combination channel and nut seat are thus mounted, (b) a nut or zero fret movably mounted in said nut seat, (c) means to adjust the elevation of said nut, said elevation-adjustment means comprising screws threaded vertically through said nut and seated on a bottom wall of said nut seat, (d) a row of string-clamping elements mounted in said channel, longitudinally of said channel, the central one of said elements in said row being fixedly mounted in said channel, said central one having a noncircular opening therethrough, the ones of said elements in said channel on one side of said central element having openings therethrough adapted to receive in nonthreaded relationship an externally-threaded bolt portion, said bolt portion having a head at the outer end thereof adapted to be rotated manually by the musician, the ones of said elements on the other side of said central element having noncircular openings therethrough, (e) an internally-threaded bolt portion having a noncircular shape adapted to be received in said elements on said other side of said central element, and also in said central element, the inner end of said internally-threaded section being adapted to threadedly receive the inner end of said first bolt portion at said central element, said first and second bolt portions being inserted through said elements and threadedly connected to each other, and (f) a cam element mounted at the outer end of said internally-threaded bolt portion, said cam element having a cam crank to effect highmechanical-advantage operation of said cam and to cause said cam to bear against said row of elements to compress said row and thus clamp the strings.

3. A method of clamping, against longitudinal movements, predetermined adjacent regions of the strings of an electric guitar, said method comprising:

(a) providing a row of clamping elements transversely of the guitar strings and having the different guitar strings sandwiched in different spaces between various ones of said clamping elements, (b) mounting both a manually-operable threaded-fastener element, and a manually-operable three-position cam, in such relationship to said row that either said fastener element, or said cam and threaded-fastener element conjointly, will effect endwise compression of said row, (c) manually moving said cam to its intermediate position, (d) thereafter effecting hand turning of said fastener element to cause said clamping elements to seat on said strings, (e) thereafter manually shifting said cam to its full-clamp position to effectively clamp said strings against longitudinal movements, and (f) thereafter manually shifting said cam to a release position freeing said strings for tuning or replacement.

* * * * *